US011452658B2

(12) United States Patent
Senska

(10) Patent No.: US 11,452,658 B2
(45) Date of Patent: Sep. 27, 2022

(54) LIMB POSITIONING SYSTEM AND METHOD OF MANUFACTURE

(71) Applicant: Brad Senska, Prescott Valley, AZ (US)

(72) Inventor: Brad Senska, Prescott Valley, AZ (US)

( * ) Notice: Subject to any disclaimer, the term of this patent is extended or adjusted under 35 U.S.C. 154(b) by 463 days.

(21) Appl. No.: 16/164,387

(22) Filed: Oct. 18, 2018

(65) Prior Publication Data

US 2020/0121536 A1 Apr. 23, 2020

(51) Int. Cl.
*A61G 13/12* (2006.01)
*A61G 13/08* (2006.01)

(52) U.S. Cl.
CPC ..... *A61G 13/129* (2013.01); *A61G 13/08* (2013.01); *A61G 13/1235* (2013.01)

(58) Field of Classification Search
CPC .... A61G 13/129; A61G 13/08; A61G 13/101; A61G 13/12; A61G 13/1235; A61G 13/124; A61M 5/52; Y10T 403/7105; Y10T 403/7129; Y10T 403/7141; Y10T 403/7171; Y10T 403/7194; Y10T 24/1441; Y10T 24/1443; F16L 33/04
See application file for complete search history.

(56) References Cited

U.S. PATENT DOCUMENTS 1,516,795 A * 11/1924 Schwarting ..... A61G 13/12 43/25
4,564,164 A * 1/1986 Allen ..... A61G 13/12 248/118
5,116,008 A * 5/1992 Allen ..... F16B 7/04 248/229.14
2001/0039680 A1* 11/2001 Boucher ..... A61G 13/0072 5/623
2005/0052066 A1* 3/2005 Wright ..... A61F 5/3761 297/411.36
2005/0059866 A1* 3/2005 Bjork ..... A61B 90/50 600/227
2010/0018537 A1* 1/2010 Soto ..... A61G 13/12 128/845
2011/0152046 A1* 6/2011 Rochford ..... A63B 21/16 482/131
2015/0351707 A1* 12/2015 Sampognaro ..... A61B 6/0407 128/877
2019/0201258 A1* 7/2019 Di Lauro ..... A61G 13/101

* cited by examiner

*Primary Examiner* — Keri J Nelson
*Assistant Examiner* — Kevin S Albers
(74) *Attorney, Agent, or Firm* — Snell & Wilmer L.L.P.

(57) ABSTRACT

The present disclosure provides a subassembly of a limb positioning system, the subassembly comprising a first clamp comprising an aperture and a first socket, a crossbar extending through the aperture of the first clamp, and a first ball coupled to a first cuff, wherein the first ball is configured to be inserted into the first socket of the first clamp and allow rotation of the first cuff relative to the first clamp.

19 Claims, 8 Drawing Sheets

LIMB POSITIONING SYSTEM AND METHOD OF MANUFACTURE

FIELD OF THE DISCLOSURE

The present disclosure relates to limb positioning systems and methods, and more specifically, to upper body limb positioning systems and methods.

BACKGROUND OF THE DISCLOSURE

Patients with upper body joint issues, such as shoulder or elbow joint issues, benefit from proper positioning of the limbs in order to properly conduct a procedure or to assist in the healing or treatment process after surgery. Conventionally, these patients are placed in a desired position through the use of various objects such as pillows or straps in an impromptu manner or, in some cases, through human assistance. Such positioning procedures, however, may be inconsistent, uncomfortable, or biomechanically improper. Further, some patients may react poorly in the presence of human assistants by consciously or subconsciously resisting the desired position, thereby adversely affecting the quality of treatment or healing process.

SUMMARY OF THE DISCLOSURE

A subassembly of a limb positioning system may comprise a first clamp comprising an aperture and a first socket, a crossbar extending through the aperture of the first clamp, and a first ball coupled to a first cuff, wherein the first ball is configured to be inserted into the first socket of the first clamp and allow rotation of the first cuff relative to the first clamp.

In various embodiments, the first clamp may be configured to rotate about the crossbar and the first clamp is configured to translate along the crossbar. The subassembly may further comprise a second clamp comprising an aperture and a second socket, the second clamp configured to be coupled to the crossbar via the aperture. The second clamp may be configured to rotate about the crossbar and the second clamp is configured to translate along the crossbar. The subassembly may further comprise a second cuff coupled to a second ball, wherein the second ball is configured to be inserted into the second socket of the second clamp and allow rotation of the second cuff relative to the second clamp. The first clamp may further comprise a key hole feature configured to relieve stresses in the first clamp. The crossbar may be configured to be inserted through an aperture in an extension member and translate relative to the extension member. The extension member may comprise a latch configured to loosen or tighten a connection between the crossbar and the extension member. The subassembly may further comprise a neck, wherein the extension member is configured to be inserted into the neck and translate and rotate relative the neck. The first clamp may further comprise a first latch configured to loosen and tighten a connection between the first clamp and the crossbar. The first clamp may further comprise a second latch configured to loosen and tighten a connection between the first ball and the first socket of the first clamp. The first ball may be configured to partially protrude from a surface of the first clamp when the first ball is inserted into the first socket. The neck may comprise a flange configured to be coupled to a plate via a plurality of fasteners. The subassembly may be configured to be coupled to a stand comprising a first portion and a second portion slidably coupled to the first portion.

The first portion may comprise an outer wall thickness less than an inner wall thickness of the second portion. The stand may be configured to be mounted to a base comprising a plurality of wheels configured to translate the subassembly over a ground surface.

A method of manufacturing a subassembly of a limb positioning system may comprise coupling a first clamp to a crossbar such that the first clamp is configured to rotate and translate relative to the crossbar, and coupling a first ball of a first cuff to a first socket of the first clamp such that the first cuff is configured to rotate with the first ball in any direction about the first socket.

In various embodiments, the method may further comprise inserting the crossbar through an aperture in an extension member such that the crossbar is configured to rotate and translate relative to the extension member. The method may further comprise inserting the extension member into a neck such that the extension member is configured to rotate and translate relative to the neck. The method may further comprise coupling a flange of the neck to a plate via a plurality of fasteners The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with upper body limb positioning systems. However, various aspects of the disclosed embodiments may be adapted for performance in a variety of other systems such as lower body limb positioning systems. As such, numerous applications of the present disclosure may be realized.

As used herein, "aft" refers to the direction associated with the tail of an aircraft, or generally, to the direction of exhaust of the gas turbine. As used herein, "forward" refers to the direction associated with the nose of an aircraft, or generally, to the direction of flight or motion.

Limb positioning systems, as disclosed herein, may contain one or more movement mechanisms capable of positioning a limb in a desired position for surgery or post-operation treatment and/or rehabilitation. For example, in various situations, it may be desirable to position a patient's arm such that an amount of joint congruency in the shoulder joint is minimized. In various embodiments, limb positioning systems as disclosed herein may be configured to allow the shoulder joint to rotate in a medial and lateral direction, flex, extend, abduct, adduct, or otherwise move to position a patient in a desired position. Limb positioning systems disclosed herein may further allow the elbow joint to flex, extend, pronate, or supinate, or otherwise move to position a patient in a desired position.

Figure 1:
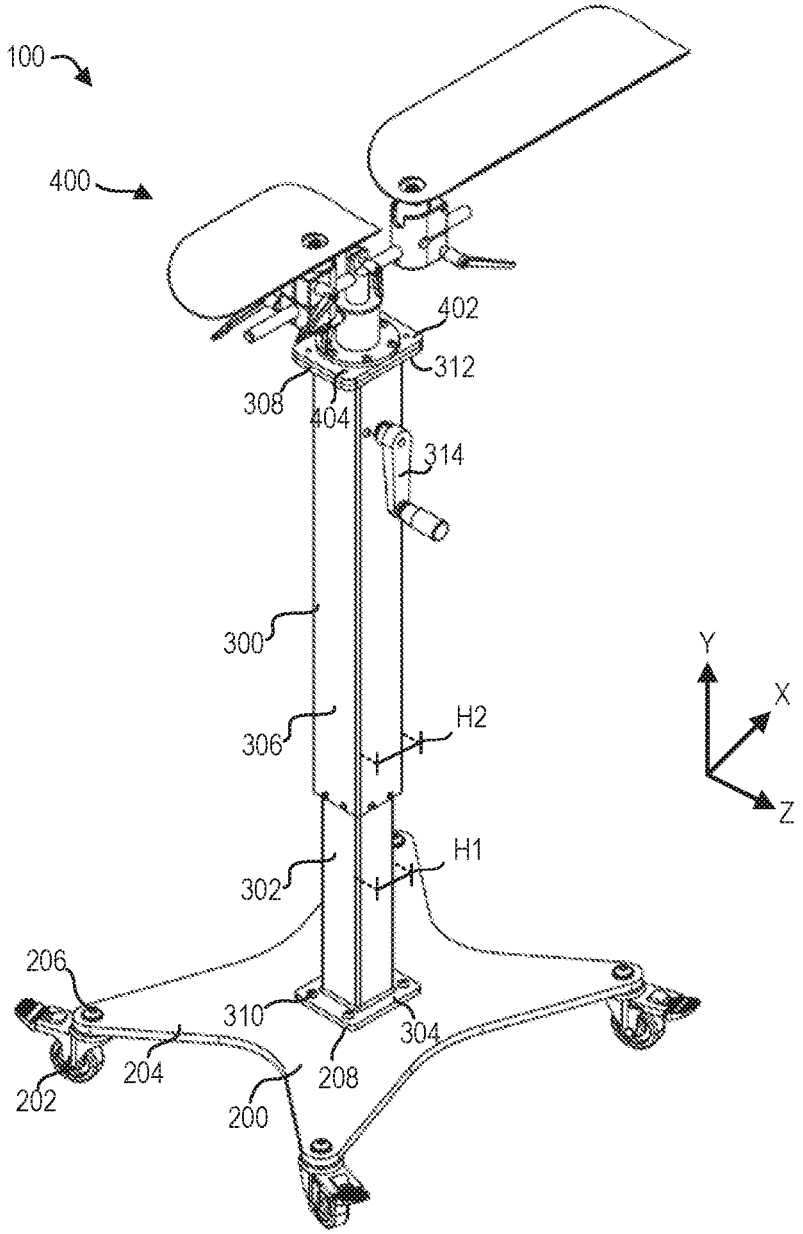
FIG. 1 illustrates a perspective view of a limb positioning system, in accordance with various embodiments.

Accordingly, with reference to FIG. 1, limb positioning system 100 is illustrated, in accordance with various embodiments. Limb positioning system 100 may comprise a base 200, a stand 300 coupled to base 200, and a subassembly 400 coupled to stand 300. Base 200 may be configured to maneuver limb positioning system 100 about a ground surface in order to properly position limb positioning system 100 near a patient. For example, in various embodiments, base 200 may comprise one or more wheels 202 coupled to a base plate 204 of base 200. In various embodiments, base plate 204 may comprise any suitable material capable of supporting stand 300 and subassembly 400 such as a stainless steel, steel alloy, aluminum, aluminum alloy, composite material, carbon fiber material, polymer material or any other suitable material. Wheels 202 may be coupled to base plate 204 through a number of wheel apertures 206 extending through base plate 204. In various embodiments, wheels 202 may be coupled to base plate 204 via one or more fasteners such as screws, rivets, nuts and bolts, sockets, pins, or the like. In various embodiments, wheels 202 may comprise a wheel comprising a locking mechanism such as a caster wheel. As such, wheels 202 may be configured to be locked in place such that rotation of wheels 202 is prevented, thereby preventing limb positioning system 100 from moving as a result of forces acting on limb positioning system 100.

Stand 300 may be coupled to base plate 204 of base 200 via one or more fasteners such as screws, rivets, nuts and bolts, sockets, pins, or the like. In various embodiments, stand 300 may comprise a first portion 302 comprising a flange 304 and a second portion 306 comprising a flange 308. Flange 304 may be formed at a bottom of second portion 306 and may comprise a plurality of apertures 310 extending there through and configured to mate with a number of corresponding apertures 208 extending through base plate 204. Flange 308 may be formed at a top portion of second portion 306 and may comprise a plurality of apertures 312 extending there through and configured to mate with a number of corresponding apertures 404 in plate 402 of subassembly 400.

In various embodiments, first portion 302 may be configured to be slidably coupled with second portion 306. For example, in various embodiments, first portion 302 may comprise an outer wall thickness H1 less than an inner wall thickness H2 of second portion 306 such that second portion 306 may be inserted over first portion 302 and translate relative to first portion 302. Stand 300 may comprise an adjustment mechanism 314 configured to tighten and loosen second portion 306 relative to first portion 302. For example, in various embodiments, adjustment mechanism 314 may comprise a rack and pinion mechanism comprising a crank, rack, and pinion, wherein a crank may be used to tighten and/or loosen the connection between first portion 302 and second portion 306. As such, second portion 306 may be raised and/or lowered (in the Y-direction) relative to first portion 302 and tightened such that subassembly 400 may be positioned at different levels according to a desired elevation of a patient. While described herein with reference to a rack and pinion mechanism, adjustment mechanism 314 is not limited in this regard and may comprise any other mechanism capable of raising and/or lowering second portion 306 and fixing a position of second portion 306. In various embodiments, adjustment mechanism 314 may comprise a rack and screw mechanism, nut and bolt mechanism, push-pull pin mechanism or other suitable mechanism. While illustrated in FIG. 1 as comprising a square cross-sectional shape, first portion 302 and second portion 306 are not limited in this regard and may comprise other cross-sectional shape such as a circle, rectangle, triangle, or polygon comprising any number of sides.

Figure 2:
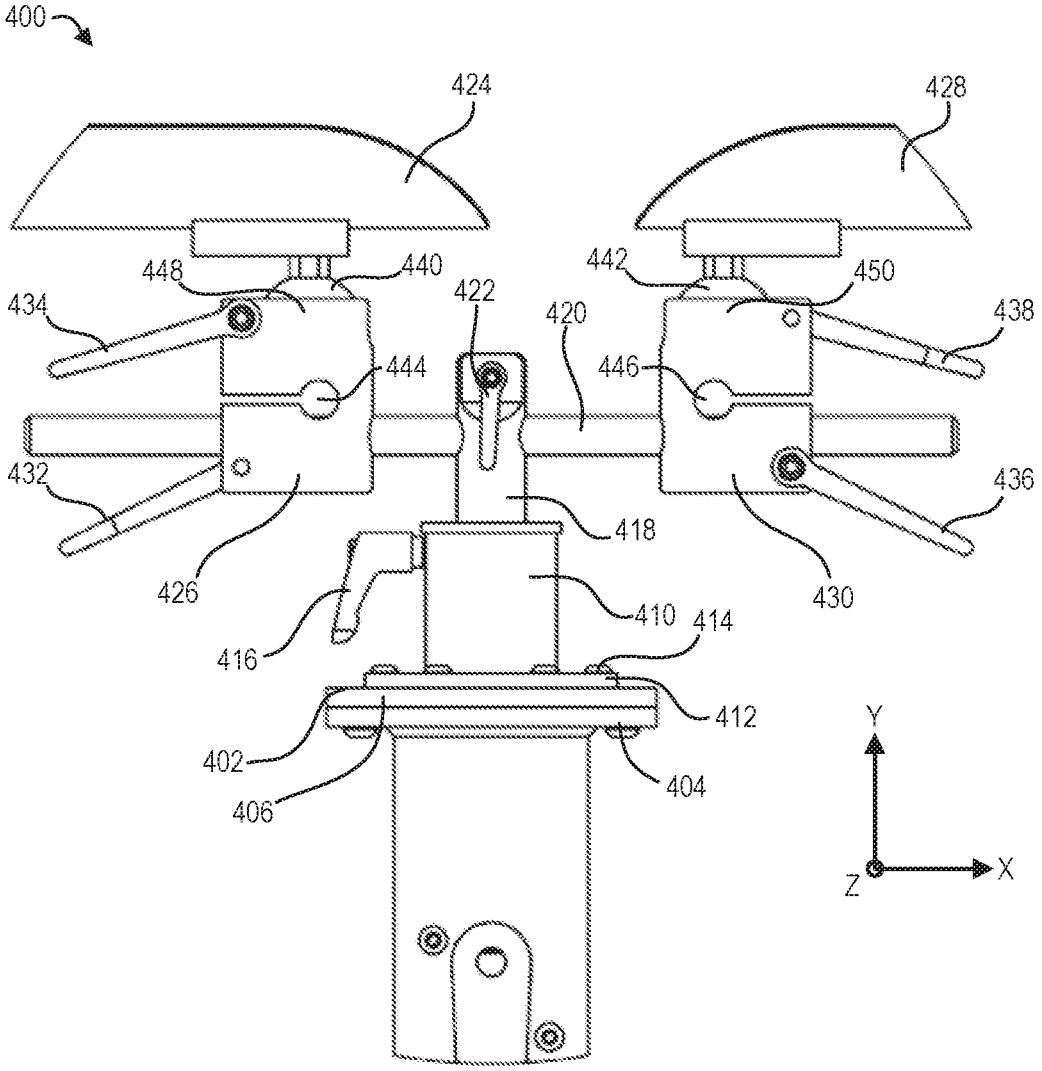
FIG. 2 illustrates a side view of a subassembly of a limb positioning system in a standard configuration, in accordance with various embodiments.

With reference to FIG. 2, a side view of subassembly 400 of limb positioning system 100 is illustrated in a standard configuration, in accordance with various embodiments. Subassembly 400 may be configured to position and stabilize a limb (such as a human limb) in a desired position. As such, subassembly 400 may comprise a plurality of movement mechanisms configured to allow rotation, translation, or pivoting of various components relative to one another.

In various embodiments, subassembly 400 may comprise a neck 410 comprising a flange 412 comprising a plurality of apertures 414 extending there through and configured to mate with a number of corresponding apertures 406 extending through plate 402. In various embodiments, apertures 414 and apertures 406 may be positioned radially inward (toward the Y-axis) relative to apertures 404 and configured to couple neck 410 to plate 402. Neck 410 may therefore be coupled to plate 402 via a number of fasteners extending through the plurality of apertures 414 in flange 412 and a plurality of apertures 406 extending through plate 402. In turn, plate 402 may be coupled to stand 300 via a number of fasteners extending through the plurality of apertures 404. In various embodiments, the plurality of fasteners may comprise screws, rivets, nuts and bolts, sockets, pins, or the like.

Neck 410 may comprise an adjustment mechanism 416 configured to allow rotation (about the Y-axis) and translation (along the Y-axis) of an extension member 418 configured to be inserted into neck 410. In various embodiments, adjustment mechanism 416 may comprise a rack and pinion mechanism, a rack and screw mechanism, nut and bolt mechanism, push-pull pin mechanism or other suitable mechanism configured to allow translation and rotation of extension member 418 relative to neck 410 in a non-discrete manner. For example, adjustment mechanism 416 may be actuated (for example, pulled, pushed, or rotated) such that a connection between extension member 418 and neck 410 is loosened and extension member 418 may be translated upward (in the positive Y-direction) or downward (in the negative Y-direction) and rotated (in either direction about the Y-axis) relative to neck 410. Upon arriving at a desired position, adjustment mechanism 416 may be actuated again such that a connection between extension member 418 and neck 410 is tightened, thereby fixing extension member 418 and neck 410 together and preventing relative movement thereof. In such a way, subassembly 400 may accommodate patients of varying heights via translation of extension member 418 and be configured to allow horizontal adduction and abduction of the shoulder joint via rotation of extension member 418.

In various embodiments, extension member 418 may be configured to receive a crossbar 420 extending through an aperture in extension member 418. Crossbar 420 may be positioned perpendicular to extension member 418 and be configured to rotate with extension member 418 as extension member 418 rotates relative to neck 410 about the Y-axis. In various embodiments, extension member 418 may comprise a latch 422 configured to loosen and tighten a connection between extension member 418 and crossbar 420.

Figure 3:
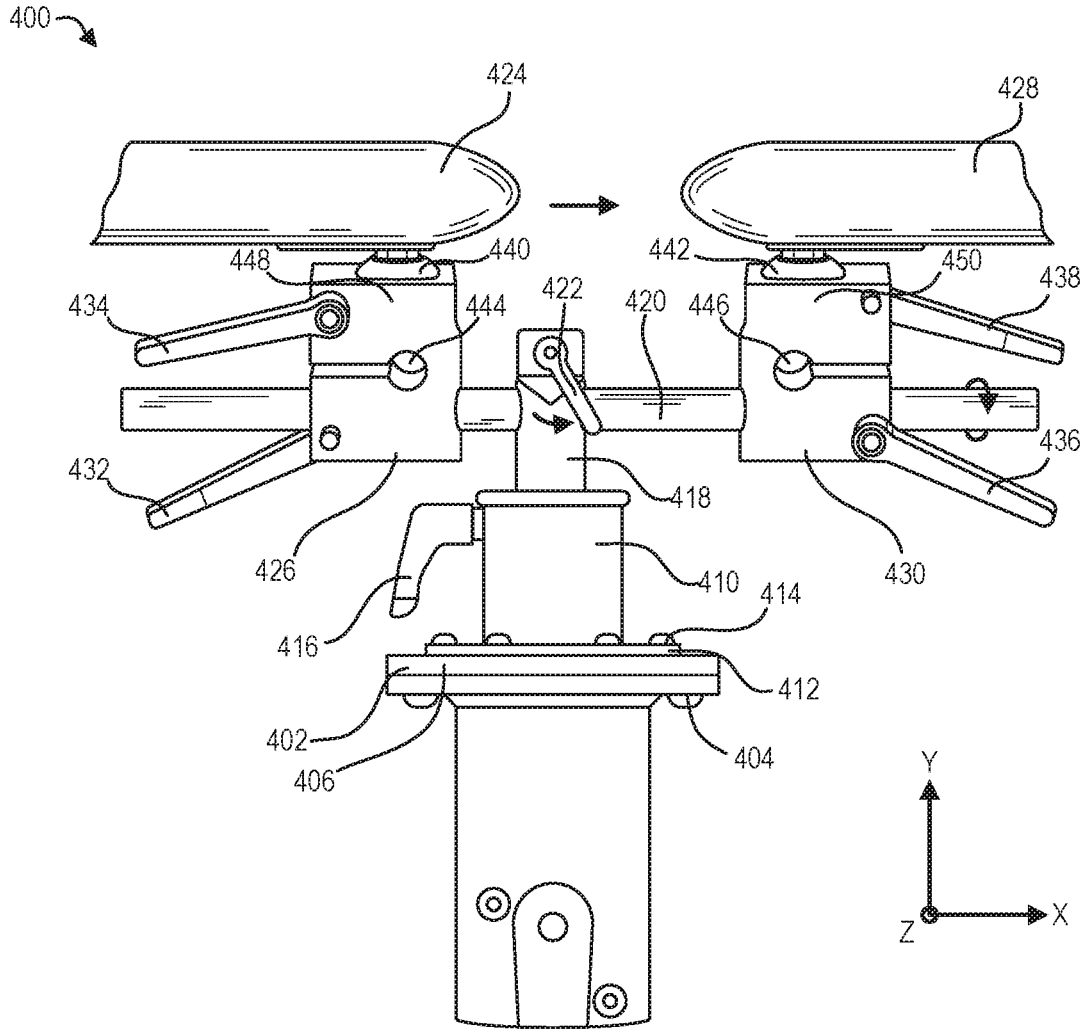
FIG. 3 illustrates a side view of the subassembly of FIG. 2 in a first adjusted configuration, in accordance with various embodiments.

For example, referring to FIG. 3, subassembly 400 is illustrated in a first adjusted configuration, in accordance with various embodiments. In a first adjusted configuration, latch 422 may be opened such that a connection between extension member 418 and crossbar 420 is loosened to allow movement of crossbar 420 relative to extension member 418. Crossbar 420 may translate (along the X-axis) in either direction and rotate relative to extension member 418 (about the X-axis) in either direction. As illustrated in the present embodiment, crossbar 420 is translated in the positive X-direction and rotated about the X-axis as indicated by the arrows, however crossbar 420 is not limited in this regard and may translate in negative X-direction and/or rotate about the X-axis in the opposite direction. Upon arriving at a desired configuration, latch 422 may be closed, thereby tightening the connection between crossbar 420 and extension member 418 and constraining subassembly 400 in an adjusted configuration. In such a way, subassembly 400 may allow protraction and retraction of the shoulder joint via translation of crossbar 420 relative to extension member 418, and also allow pronation and supination of a patient's forearm via rotation of crossbar 420 relative to extension member 418.

Figure 4:
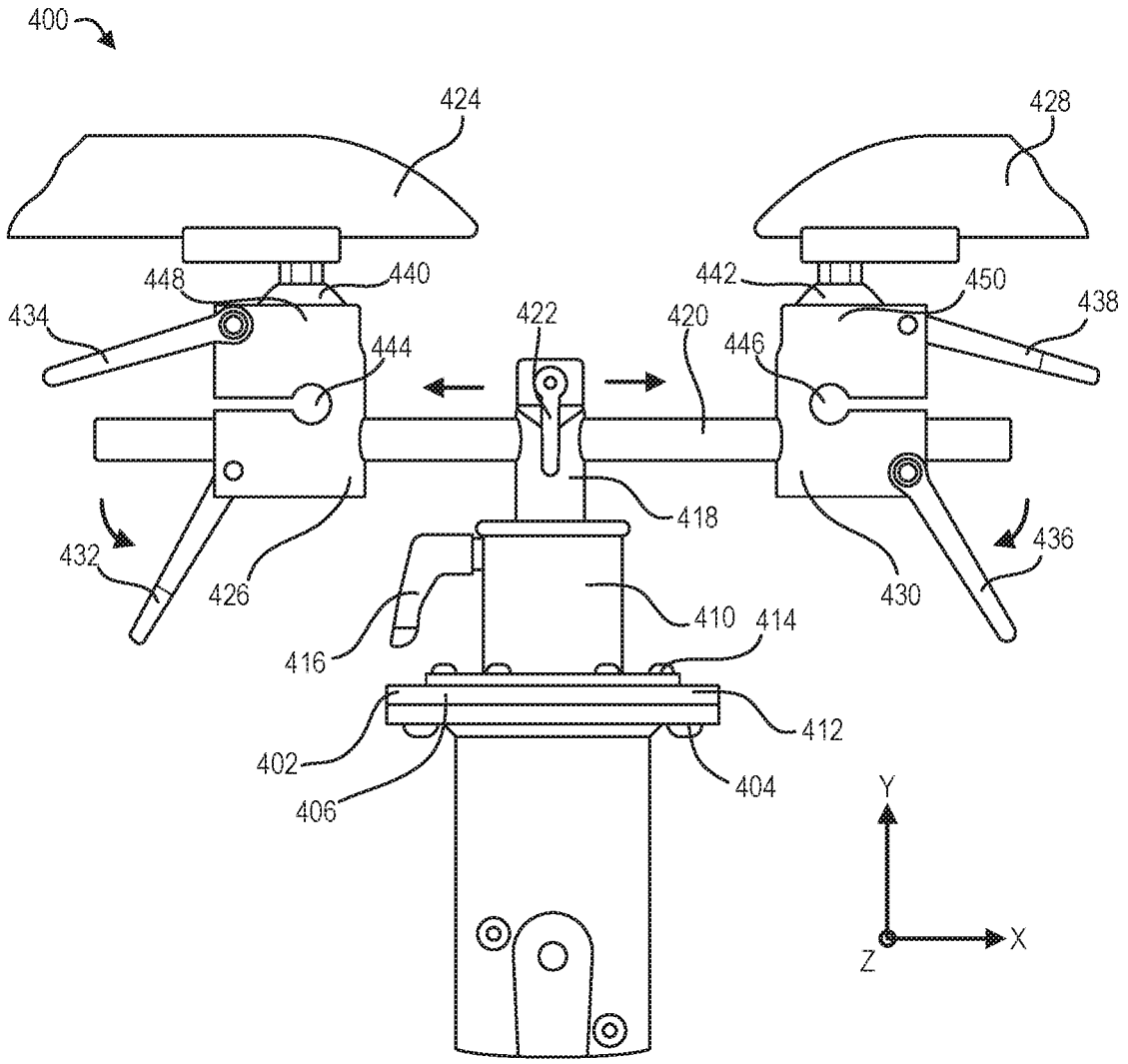
FIG. 4 illustrates a side view of the subassembly of FIG. 2 in a second adjusted configuration, in accordance with various embodiments.

Subassembly 400 is illustrated in a second adjusted configuration in FIG. 4, in accordance with various embodiments. Subassembly 400 may comprise a first cuff 424 coupled to crossbar 420 via a first clamp 426 and a second cuff 428 coupled to crossbar 420 via a second clamp 430. First clamp 426 and second clamp 430 may be configured to receive crossbar 420 through an aperture extending through first clamp 426 and second clamp 430. In various embodiments, a patient may be configured to place his/her upper arm on first cuff 424 and his/her forearm on second cuff 428 or vice versa. In various embodiments, first cuff 424 and second cuff 428 may be formed as partial cylinders configured to partially enclose a patient's upper arm and/or forearm. First cuff 424 and second cuff 428 may comprise any suitable material, for example, a metallic material such as a stainless steel, steel alloy, aluminum, aluminum alloy, a composite material, a thermoplastic material, or polymer material in various embodiments. First cuff 424 and second cuff 428 may be configured to be fitted with a padded material such as a foam material, rubber material, or polymer material for the comfort of a patient. In various embodiments, the padded material may be covered with a cover material such as leather to contain the padded material and allow the padded material to easily be sanitized. In various embodiments, first cuff 424 and second cuff 428 may comprise one or more straps coupled to first cuff 424 and second cuff 428 and configured to restrain movement of a patient relative to first cuff 424 and second cuff 428.

In various embodiments, first clamp 426 may comprise a first latch 432 and a second latch 434 and second clamp 430 may comprise a first latch 436 and a second latch 438. First latch 432 of first clamp 426 and first latch 436 of second clamp 430 may be configured to allow translation and rotation of first clamp 426 and second clamp 430, respectively, relative to crossbar 420. First latch 432 of first clamp 426 and first latch 436 of second clamp 430 may be actuated by rotating a handle of first latch 432 and first latch 436, thereby loosening a connection between first clamp 426 and crossbar 420 and second clamp 430 and crossbar 420. For example, in FIG. 4, first clamp 426 is illustrated translated along crossbar 420 in the negative X-direction, while second clamp 430 is illustrated translated along crossbar 420 in the positive X-direction. As such, first cuff 424 and second cuff 428 may be moved together in either direction along the X-axis via movement of crossbar 420 relative to extension member 418, or be moved individually in either direction along the X-axis via first clamp 426 and second clamp 430. Likewise, while not illustrated in FIG. 4, first clamp 426 and second clamp 430 may be configured to rotate in either direction about the X-axis such that first cuff 424 and second cuff 428 may rotate together via rotation of crossbar 420 relative to extension member 418 or may rotate individually in either direction about the X-axis via first clamp 426 and second clamp 430. In such a way, subassembly 400 may be configured to adjust to a length of a patient's arm via translation of first clamp 426 and second clamp 430, while also allowing pronation and supination of a patient's forearm via rotation of first clamp 426 and second clamp 430 relative to crossbar 420. Once a patient's arm is positioned in a desired position, first latch 432 and first latch 436 may be actuated to tighten the connection between first clamp 426 and crossbar 420 and second clamp 430 and crossbar 420.

Figure 5:
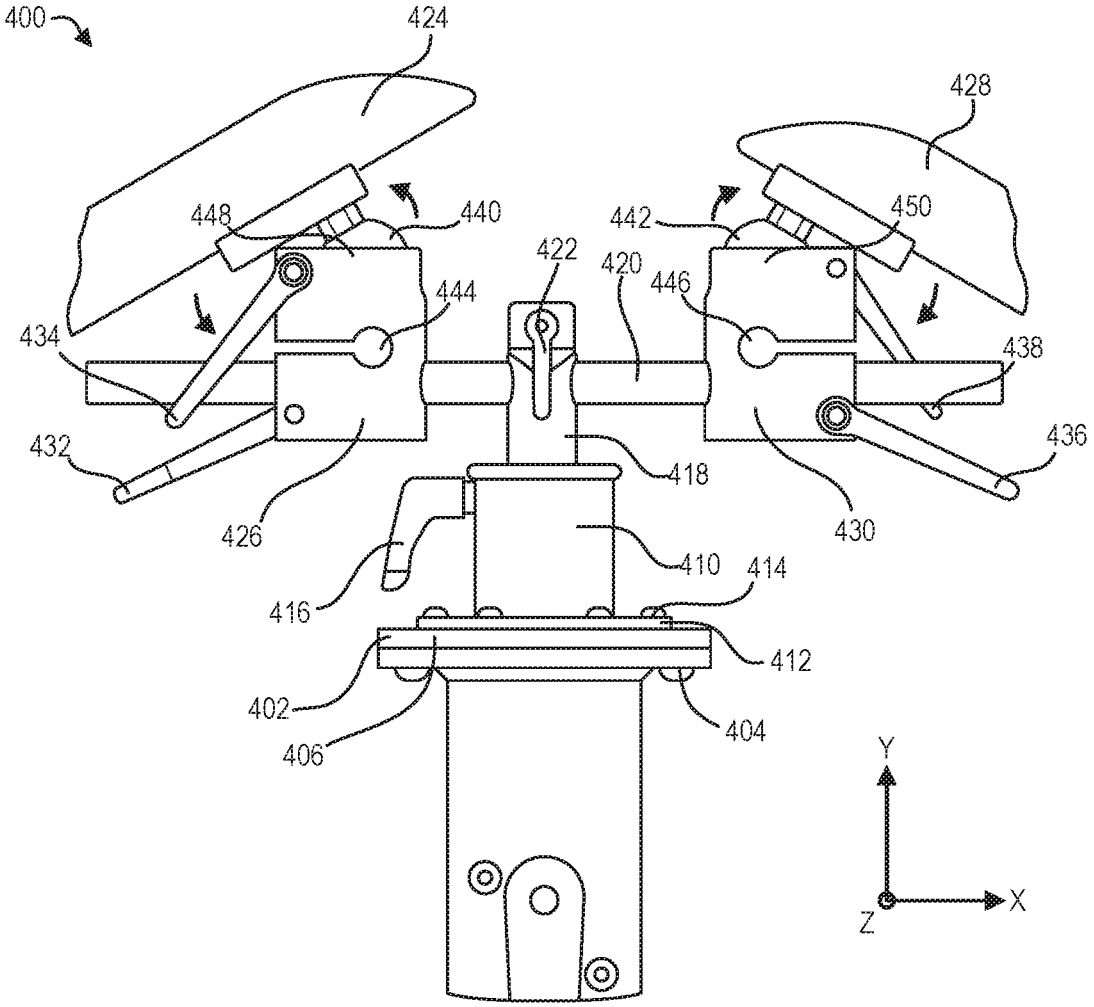
FIG. 5 illustrates a side view of the subassembly of FIG. 2 in a third adjusted configuration, in accordance with various embodiments.

Referring now to FIG. 5, subassembly 400 is illustrated in a third adjusted configuration, in accordance with various embodiment. First clamp 426 may comprise a second latch 434 and second clamp 430 may comprise a second latch 438. Second latch 434 and second latch 438 may be configured to allow rotation of first cuff 424 and second cuff 428 about the X-axis, Y-axis, and Z-axis relative to first clamp 426 and second clamp 430, respectively. In various embodiments, first cuff 424 may comprise a first ball 440 extending from a bottom of first cuff 424 and configured to interact with a first socket 448 positioned on a top surface of first clamp 426. Likewise, second cuff 428 may comprise a second ball 442 extending from a bottom of second cuff 428 and configured to interact with a second socket 450 on a top surface of second clamp 430. In such a way, first cuff 424 and second cuff 428 may be configured to rotate in all directions relative to first clamp 426 and second clamp 430, respectively.

Figure 6:
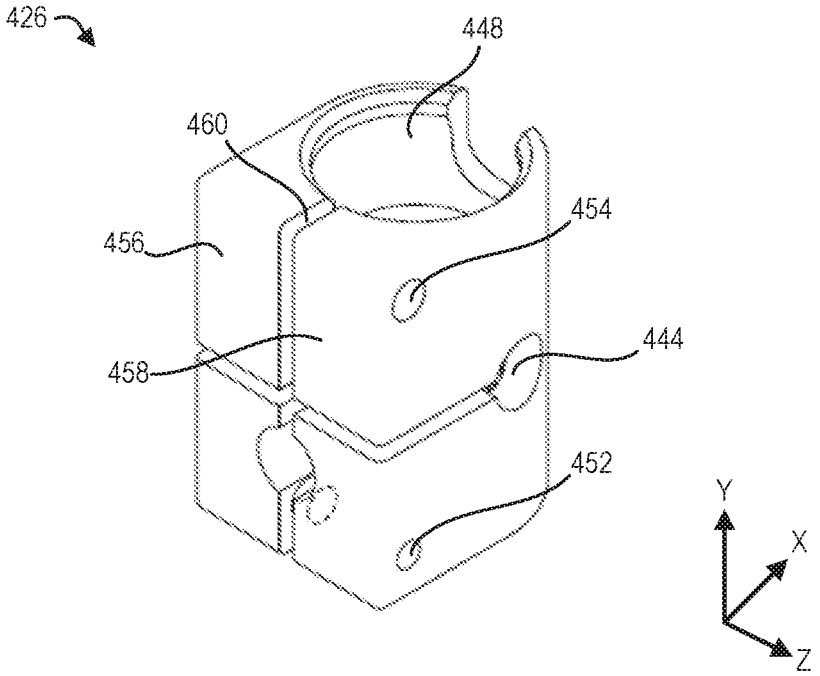
FIG. 6 illustrates a perspective view of a clamp of the subassembly of FIG. 2, in accordance with various embodiments.

Referring momentarily to FIG. 5 and FIG. 6, in various embodiments, first socket 448 and/or second socket 450 of first clamp 426 and second clamp 430 may comprise voids or indentations extending inwardly (in the negative Y-direction) from a top surface of first clamp 426 and second clamp 430, respectively. In various embodiments, first socket 448 and/or second socket 450 may comprise a geometry substantially matching that of an exterior surface of first ball 440 and second ball 442, respectively, such that first ball 440 and first socket 448 as well as second ball 442 and second socket 450 may comprise ball joints. In various embodiments, first socket 448 and second socket 450 may comprise a depth less than a height of first ball 440 and second ball 442, respectively, such that first cuff 424 and second cuff 428 may rotate to a larger degree before a bottom surface of first cuff 424 and second cuff 428 contacts a portion of first clamp 426 and second clamp 430, respectively, thereby constraining movement of first cuff 424 and second cuff 428. In other words, first ball 440 and second ball 442 may at least partially protrude from a surface of first clamp 426 and second clamp 430, respectively, when first ball 440 is inserted into first socket 448 and second ball 442 is inserted into second socket 450.

FIG. 6 illustrates a perspective view of first clamp 426, in accordance with various embodiments. Second clamp 430 may be similar to first clamp 426. First clamp 426 may comprise a first aperture 452 configured to receive first latch 432 and a second aperture 454 configured to receive second latch 434. First aperture 452 and second aperture 454 may extend in the Z-direction through first clamp 426. For example, in various embodiments, first aperture 452 and second aperture 454 may extend through a first half 456 and a second half 458 of first clamp 426. First half 456 and second half 458 may be separated by a gap 460.

In various embodiments, second latch 434 may be loosened such that first ball 440 may freely rotate within first socket 448. Upon arriving at a desired position, second latch 434 may be tightened, thereby constraining movement of first ball 440 relative to first clamp 426. For example, in various embodiments, second latch 434 may be configured to compress first half 456 and second half 458, thereby decreasing a width of gap 460. By decreasing a width of gap 460, a diameter of first socket 448 may also be decreased, thereby constraining the movement of first ball 440 within first socket 448. A similar mechanism may be used to constrain first clamp 426 relative to crossbar 420 through movement of first latch 432. As discussed further below, first clamp 426 may also comprise a keyhole feature 444 configured to relieve stress on first clamp 426 near first latch 432 and second latch 434.

Returning now to FIG. 5, second latch 434 may be actuated such that a connection between first ball 440 and second socket 450 of first clamp 426 may be loosened. First cuff 424 may then be rotated, for example, about the Z-axis in a counterclockwise direction and second latch 434 may be actuated such that a connection between first ball 440 and first socket 448 of first clamp 426 may be tightened. Likewise, second latch 438 may be actuated such that a connection between second ball 442 and second socket 450 of second clamp 430 may be loosened. Second cuff 428 may then be rotated, for example, about the Z-axis in a clockwise direction and second latch 438 may be actuated such that a connection between second ball 442 and second socket 450 of second clamp 430 may be tightened.

Figure 7:
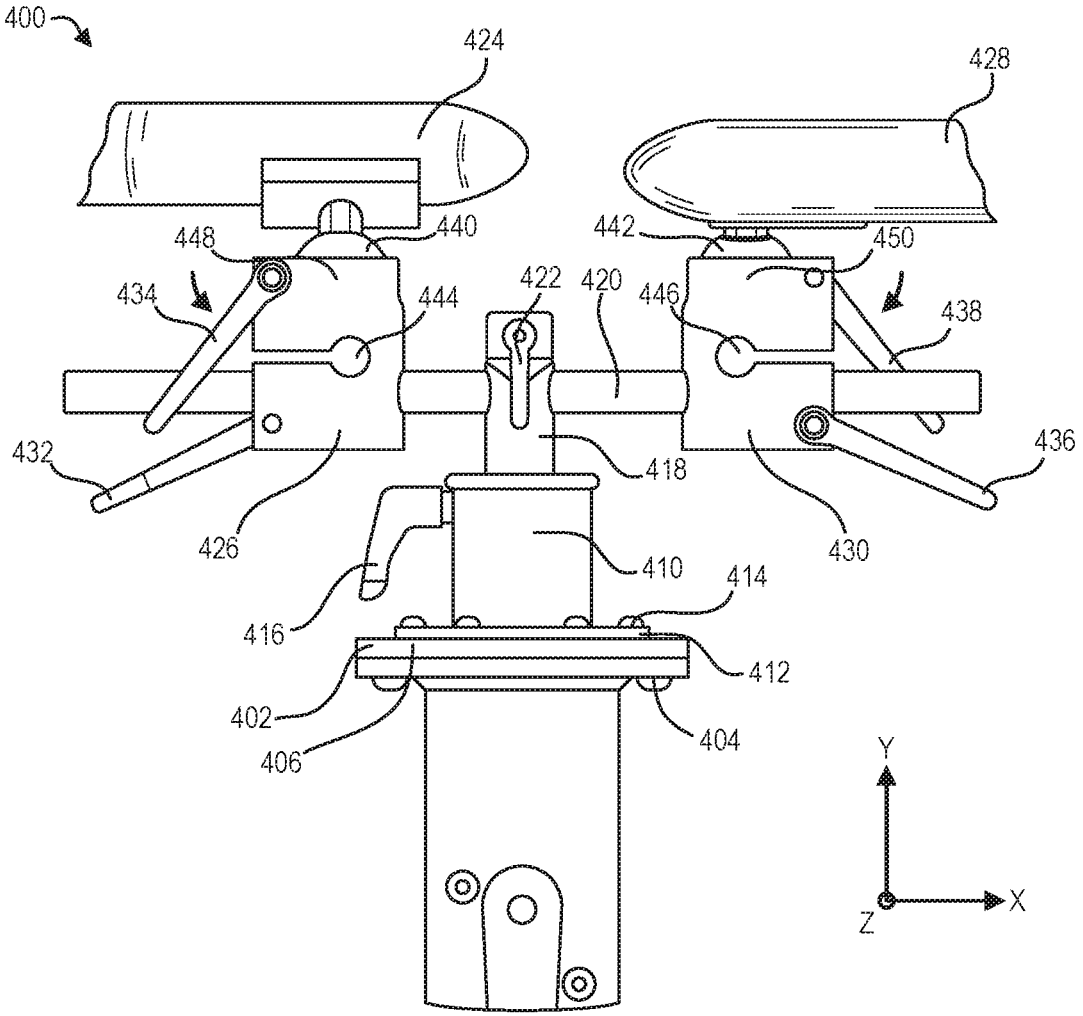
FIG. 7 illustrates a side view of the subassembly of FIG. 2 in a fourth adjusted configuration, in accordance with various embodiments.

Moving on and with reference to FIG. 7, subassembly 400 is illustrated in a fourth adjusted configuration, in accordance with various embodiments. First cuff 424 and second cuff 428 may also be configured such that first cuff 424 and second cuff 428 may rotate about the Y-axis and/or X-axis. For example, second latch 434 may be actuated such that a connection between first ball 440 and first socket 448 of first clamp 426 may be loosened. First cuff 424 may then be rotated, for example, about the X-axis in either direction and second latch 434 may be actuated such that a connection between first ball 440 and the socket of first clamp 426 may be tightened. Likewise, second latch 438 may be actuated such that a connection between second ball 442 and second socket 450 of second clamp 430 may be loosened. Second cuff 428 may then be rotated, for example, about the X-axis in either direction and second latch 438 may be actuated such that a connection between second ball 442 and second socket 450 of second clamp 430 may be tightened. In such a way, first cuff 424 and second cuff 428 may be configured to rotate in any direction to accommodate movement of a patient's arm, for example, allowing a shoulder joint of a patient to flex, extend, abduct, adduct, allowing a patient's elbow joint to flex or extend, or allowing a patient's forearm to supinate or pronate.

In various embodiments, first cuff 424 and second cuff 428 may be configured to rotate in order to accommodate varying ranges of motion. For example, in various embodiments, first cuff 424 and second cuff 428 may be configured to rotate about the X-axis and Z-axis approximately 180 degrees and about the Y-axis approximately 360 degrees.

In various embodiments, first clamp 426 may include a key hole feature 444 and second clamp 430 may include a key hole feature 446. Key hole features 444 and 446 extend partially through first clamp 426 and second clamp 430, respectively, such that a cavity is formed in first clamp 426 and second clamp 430. Key hole features 444 and 446 may extend inwardly (as illustrated, toward the Y-axis) from an outward face of each of the first clamp 426 and second clamp 430. For example, in various embodiments, key hole features 444 and 446 may comprise a rectangular channel (when viewed in the X-Y plane) which may terminate in a circular channel at an interior point in first clamp 426 and second clamp 430. Key hole features 444 and 446 may be configured to relieve stresses throughout first clamp 426 and or second clamp 430. For example, as first latch 432, first latch 436, second latch 434, and second latch 438 are actuated, stresses may build near a location of the latches in first clamp 426 and/or second clamp 430. Key hole features 444 and 446 may relieve these stresses by reducing stress concentrations near first latch 432, first latch 436, second latch 434, and/or second latch 438. Accordingly, first latch 432 and/or first latch 436 may be tightened and/or loosened without affecting the condition of second latch 434 and/or second latch 438 or vice versa. In such a way, various latches of first clamp 426 and second clamp 430 may be loosened and/or tightened without risk of another latch being loosened, thereby unintentionally moving other components of subassembly 400.

While described herein with reference to a standard configuration and four adjusted configurations, limb positioning system 100 and subassembly 400 is not limited in this regards. Specifically, the adjusted configurations as disclosed herein are intended to provide some of the movement capabilities associated with limb positioning system 100 and subassembly 400, however, are not intended to limit the ways in which limb positioning system 100 and/or subassembly 400 may move. For example, various embodiments of the present disclosure may contemplate combining any or all of the four adjusted configurations described herein or may include other adjusted configurations as would be appreciated by one of skill in the art. As such, limb positioning system 100 and subassembly 400 may be configured to position an arm or other limb in any desirable position as post-operative treatment or rehabilitation may require.

Figure 8:
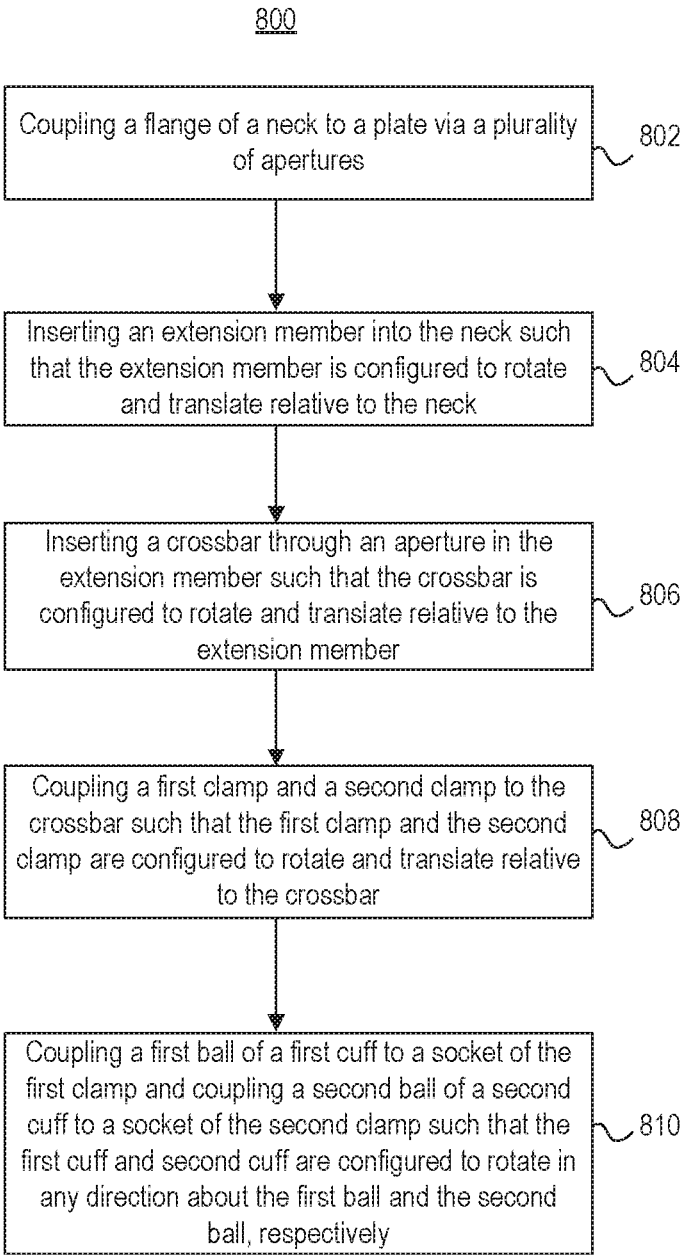
FIG. 8 illustrates a method of manufacturing a limb positioning system, in accordance with various embodiments.

A block diagram illustrating a method of manufacturing a subassembly of a limb positioning system is illustrated in FIG. 8, in accordance with various embodiments. In various embodiments, the method may comprise coupling a flange of a neck to a plate via a plurality of fasteners (Step 802). The method may further comprise inserting an extension member into the neck such that the extension member is configured to rotate and translate relative to the neck (Step 804). The method may further comprise inserting a crossbar through an aperture in the extension member such that the crossbar is configured to rotate and translate relative to the extension member (Step 806). The method may further comprise coupling a first clamp and a second clamp to the crossbar such that the first clamp and the second clamp are configured to rotate and translate relative to the crossbar (Step 808). The method may further comprise coupling a first ball of a first cuff to a socket of the first clamp and coupling a second ball of a second cuff to a socket of the second clamp such that the first cuff and second cuff are configured to rotate in any direction about the first ball and the second ball, respectively (Step 810).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, systems, and computer-readable media are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A subassembly of a limb positioning system, the subassembly comprising:

a first clamp comprising a first clamp body comprising an aperture, a first socket, and a keyhole feature, the keyhole feature disposed between the aperture and the first socket, the first clamp body is a single piece of material;

a crossbar extending through the aperture of the first clamp, a centerline of the crossbar defining a first axis;

a first ball coupled to a first cuff, wherein the first ball is configured to be inserted into the first socket of the first clamp and allow rotation of the first cuff relative to the first clamp;

a first latch aperture extending through a first half of the first clamp body and a second half of the first clamp body, wherein the first latch aperture is configured to receive a first latch for at least one of loosening and tightening a connection between the first clamp body and the crossbar; and a second latch aperture extending through the first half of the first clamp body and the second half of the first clamp body, wherein the second latch aperture is configured to receive a second latch for at least one of loosening and tightening a connection between the first ball and the first socket of the first clamp body;

wherein the keyhole feature comprises a channel terminating in a circular channel, and the channel extends along the first axis from a first face of the first clamp toward a second face of the first clamp and terminates at the circular channel;

the first half of the first clamp body is separated from the second half of the first clamp body by a gap; and the first latch aperture and the second latch aperture are located on opposite sides of the channel.

2. The subassembly of claim 1, wherein the first clamp is configured to rotate about the crossbar and the first clamp is configured to translate along the crossbar.

3. The subassembly of claim 1, further comprising:

a second clamp comprising second clamp body comprising a second aperture and a second socket, the second clamp configured to be coupled to the crossbar via the second aperture, wherein the second clamp is configured to rotate about the crossbar and the second clamp is configured to translate along the crossbar; and a second cuff coupled to a second ball, wherein the second ball is configured to be inserted into the second socket of the second clamp body and allow rotation of the second cuff relative to the second clamp, wherein:

the first cuff is a first length, the second cuff is a second length, and the first length is greater than the second length.

4. The subassembly of claim 1, wherein the crossbar is configured to be inserted through an extension member aperture in an extension member and translate relative to the extension member.

5. The subassembly of claim 4, wherein the extension member comprises a latch configured to loosen or tighten a connection between the crossbar and the extension member.

6. The subassembly of claim 4, further comprising a neck, wherein the extension member is configured to be inserted into the neck and translate and rotate relative the neck.

7. The subassembly of claim 1, wherein the first clamp further comprises:

the first latch; and the second latch.

8. The subassembly of claim 1, wherein the first ball is configured to partially protrude from a surface of the first clamp body when the first ball is inserted into the first socket.

9. The subassembly of claim 6, wherein the neck comprises a flange configured to be coupled to a plate via a plurality of fasteners.

10. The subassembly of claim 1, wherein the subassembly is configured to be coupled to a stand comprising a first portion and a second portion slidably coupled to the first portion.

11. The subassembly of claim 10, wherein the first portion comprises an outer wall thickness less than an inner wall thickness of the second portion.

12. The subassembly of claim 10, wherein the stand is configured to be mounted to a base comprising a plurality of wheels configured to translate the subassembly over a ground surface.

13. A method of manufacturing a subassembly of a limb positioning system, the method comprising:

coupling a first clamp to a crossbar by disposing the crossbar through a first aperture of the first clamp such that the first clamp is configured to rotate and translate relative to the crossbar, the first clamp comprising a first clamp body comprising the first aperture, a keyhole feature, and a first socket, the keyhole feature configured to relieve stresses in the first clamp body, the keyhole feature disposed between the first aperture and the first socket, the first clamp body is a single piece of material; and coupling a first ball of a first cuff to the first socket of the first clamp such that the first cuff is configured to rotate with the first ball in any direction about the first socket;

coupling a first latch to the first clamp body by disposing the first latch through a first latch aperture extending through a first half of the first clamp body and a second half of the first clamp body, wherein the first latch aperture is configured to receive the first latch for at least one of loosening and tightening the first ball within the first socket; and coupling a second latch to the first clamp body by disposing the second latch through a second latch aperture extending through the first half of the first clamp body and the second half of the first clamp body, wherein the second latch aperture is configured to receive the second latch for at least one of loosening and tightening the crossbar within the first aperture;

wherein the keyhole feature comprises a channel terminating in a circular channel, and the channel extends along the first axis from a first face of the first clamp toward a second face of the first clamp and terminates at the circular channel;

the first half of the first clamp body is separated from the second half of the first clamp body by a gap; and the first latch aperture and the second latch aperture are located on opposite sides of the channel.

14. The method of manufacturing of claim 13, further comprising inserting the crossbar through a second aperture in an extension member such that the crossbar is configured to rotate and translate relative to the extension member.

15. The method of manufacturing of claim 14, further comprising inserting the extension member into a neck such that the extension member is configured to rotate and translate relative to the neck.

16. The method of manufacturing of claim 15, further comprising coupling a flange of the neck to a plate via a plurality of fasteners.

17. The subassembly of claim 1, wherein the keyhole feature is configured to relieve stresses throughout first clamp.

18. The subassembly of claim 1, further comprising:

a second clamp comprising a second clamp body comprising a second aperture and a second socket, the second clamp body configured to receive the crossbar through the second aperture;

a second ball coupled to a second cuff, wherein the second ball is configured to be inserted into the second socket of the second clamp body and allow rotation of the second cuff relative to the second clamp; and an extension member comprising an extension member aperture, the crossbar configured to be inserted through the extension member aperture;

wherein the first clamp is configured to be coupled to the crossbar opposite the extension member from the second clamp.

19. The subassembly of claim 1, wherein the first latch aperture and the second latch aperture are located between the first face and the circular channel.

* * * * *